US008296042B2

(12) United States Patent
Xiao et al.

(10) Patent No.: US 8,296,042 B2
(45) Date of Patent: Oct. 23, 2012

(54) HUMIDITY DETECTION VIA AN EXHAUST GAS SENSOR

(75) Inventors: Nian Xiao, Canton, MI (US); Yi Ding, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 850 days.

(21) Appl. No.: 12/409,225

(22) Filed: Mar. 23, 2009

(65) Prior Publication Data

US 2010/0236532 A1 Sep. 23, 2010

(51) Int. Cl.
*F02D 41/26* (2006.01)

(52) U.S. Cl. ..... 701/112; 123/481; 123/677; 123/697; 123/703

(58) Field of Classification Search ..... 123/481, 123/672, 697, 677, 703; 60/285; 701/103, 701/108, 109, 110, 112
See application file for complete search history.

(56) References Cited

U.S. PATENT DOCUMENTS

| | | | | |
|---|---|---|---|---|
| 5,145,566 | A | 9/1992 | Logothetis et al. | |
| 5,735,245 | A * | 4/1998 | Kubesh et al. | 123/406.55 |
| 6,375,828 | B2 | 4/2002 | Ando et al. | |
| 6,725,848 | B2 | 4/2004 | Ramamurthy et al. | |
| 6,918,362 | B2 * | 7/2005 | Cullen | 123/90.15 |
| 7,104,228 | B2 * | 9/2006 | Cullen | 123/90.15 |
| 7,195,009 | B2 * | 3/2007 | Cullen | 123/690 |
| 7,246,604 | B2 * | 7/2007 | Cullen | 123/491 |
| 7,318,409 | B2 * | 1/2008 | Cullen | 123/399 |
| 7,398,775 | B2 * | 7/2008 | Cullen | 123/677 |
| 7,654,253 | B2 * | 2/2010 | Cullen | 123/690 |
| 7,715,976 | B1 * | 5/2010 | Xiao et al. | 701/108 |
| 8,108,130 | B2 * | 1/2012 | Scheuerer | 701/109 |
| 2011/0023855 | A1 * | 2/2011 | Van Nieuwstadt et al. | 123/703 |
| 2011/0132340 | A1 * | 6/2011 | Soltis | 123/703 |
| 2011/0132342 | A1 * | 6/2011 | Soltis et al. | 123/703 |

* cited by examiner

*Primary Examiner* — Hai Huynh
(74) *Attorney, Agent, or Firm* — Julia Voutyras; Alleman Hall McCoy Russell & Tuttle LLP

(57) ABSTRACT

Various systems and methods are described for operating an engine in a vehicle in response to an ambient humidity generated from an exhaust gas sensor. One example method comprises, during engine non-fueling conditions, where at least one intake valve and at least one exhaust valve of the engine are operating, generating an ambient humidity from the exhaust gas sensor and, under selected engine combusting conditions, adjusting an engine operating parameter based on the ambient humidity.

20 Claims, 5 Drawing Sheets

HUMIDITY DETECTION VIA AN EXHAUST GAS SENSOR

TECHNICAL FIELD

The present description relates generally to an exhaust gas sensor coupled to an exhaust system in an internal combustion engine.

BACKGROUND AND SUMMARY

Engine operating parameters such as air-fuel ratio, spark timing, and exhaust gas recirculation (EGR) may be utilized in internal combustion engines in order to increase engine efficiency and fuel economy and decrease emissions including nitrogen oxides ($NO_x$). One factor which may affect the efficiency of such operating parameters is ambient humidity. A high concentration of water in ambient air may affect combustion temperatures, dilution, etc. Therefore, control of operating parameters including air-fuel ratio, spark timing, EGR, and the like based on humidity can be used to improve engine performance.

U.S. Pat. No. 5,145,566 discloses a method to detect ambient humidity via an electrochemical oxygen pumping device. Specifically, the reference describes estimating an amount of EGR from the exhaust gas sensor in a way to eliminate errors caused by ambient humidity where the sensor reading is used with, and without, EGR flow in order to identify the amount of EGR. Further, the reference indicates that a separate sensor may also be used to measure ambient humidity, presumably by locating the second sensor outside of the exhaust gas.

The inventors herein have recognized, however, that during select conditions the exhaust gas sensor located in the exhaust gas of the engine can provide an indication of ambient humidity. Thus, in one example, a method for adjusting one or more of air-fuel ratio, spark timing, EGR, and/or the like in response to a measurement of the ambient humidity is disclosed. In one example, the method comprises generating an ambient humidity from an exhaust gas sensor during engine non-fueling conditions, in which at least one intake valve and one exhaust valve of the engine are operating and, under selected engine combusting conditions, adjusting an engine operating parameter based on the ambient humidity measurement.

In this manner, the effect of ambient humidity on various operating parameters may be reduced by using an exhaust gas sensor coupled in the engine exhaust to provide an indication of ambient humidity during select conditions. Further, in another example, an amount of EGR may be reduced during subsequent engine fueling operation as ambient humidity detected by the exhaust gas sensor increases in order to improve engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a method for operating an engine in a vehicle wherein a control system is configured to adjust one or more engine operating parameters in response to an ambient humidity generated by an exhaust gas sensor. The ambient humidity measurement may be obtained during engine non-fueling conditions, such as deceleration fuel shut off (DFSO), for example. As DFSO can occur numerous times in a drive cycle, it may be possible to generate repeated indications of the ambient humidity; thus, engine operating parameters may be adjusted for optimal engine performance with fluctuations in humidity during driving cycles (e.g., as altitude changes, as temperature changes, as a vehicle enters/exits fog or rain, etc.). Furthermore, as DFSO conditions may not continue long enough for ambient air to equilibrate in the sensor, in one example, a steady state of the ambient air may be projected in order to determine the ambient humidity.

Figure 1:
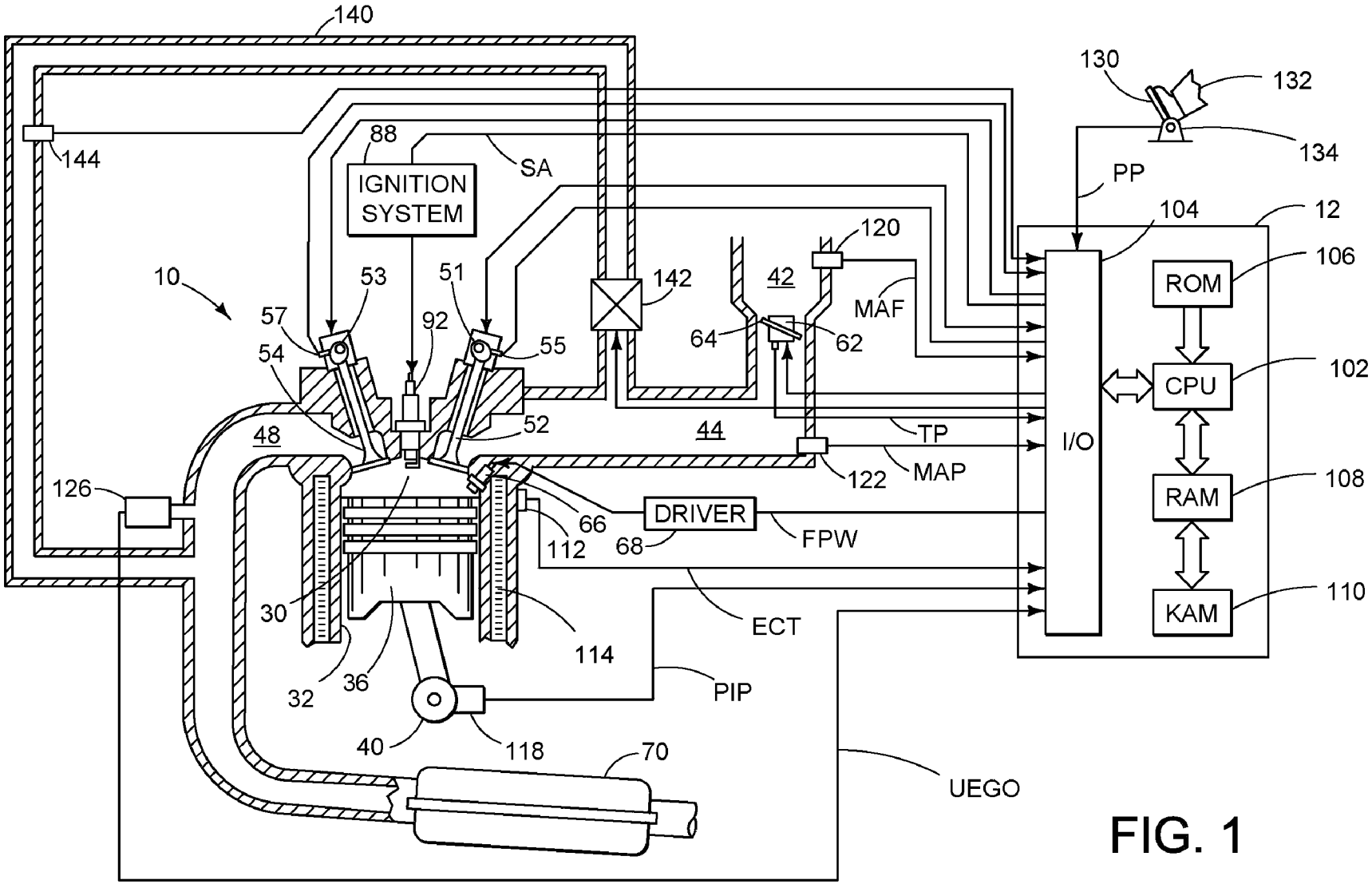
FIG. 1 shows an example embodiment of a combustion chamber in a spark ignition engine including an exhaust system and an exhaust gas recirculation system.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. Emission control device 70 is shown arranged along exhaust passage 48 downstream of exhaust gas sensor 126. Device 70 may be a three way catalyst (TWC), $NO_x$ trap, various other emission control devices, or combinations thereof. In some embodiments, during operation of engine 10, emission control device 70 may be periodically reset by operating at least one cylinder of the engine within a particular air/fuel ratio.

Further, in the disclosed embodiments, an exhaust gas recirculation (EGR) system may route a desired portion of exhaust gas from exhaust passage 48 to intake passage 44 via EGR passage 140. The amount of EGR provided to intake passage 44 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing, such as by controlling a variable valve timing mechanism.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and that each cylinder may similarly include its own set of intake/exhaust valves, fuel injector, spark plug, etc.

Figure 2:
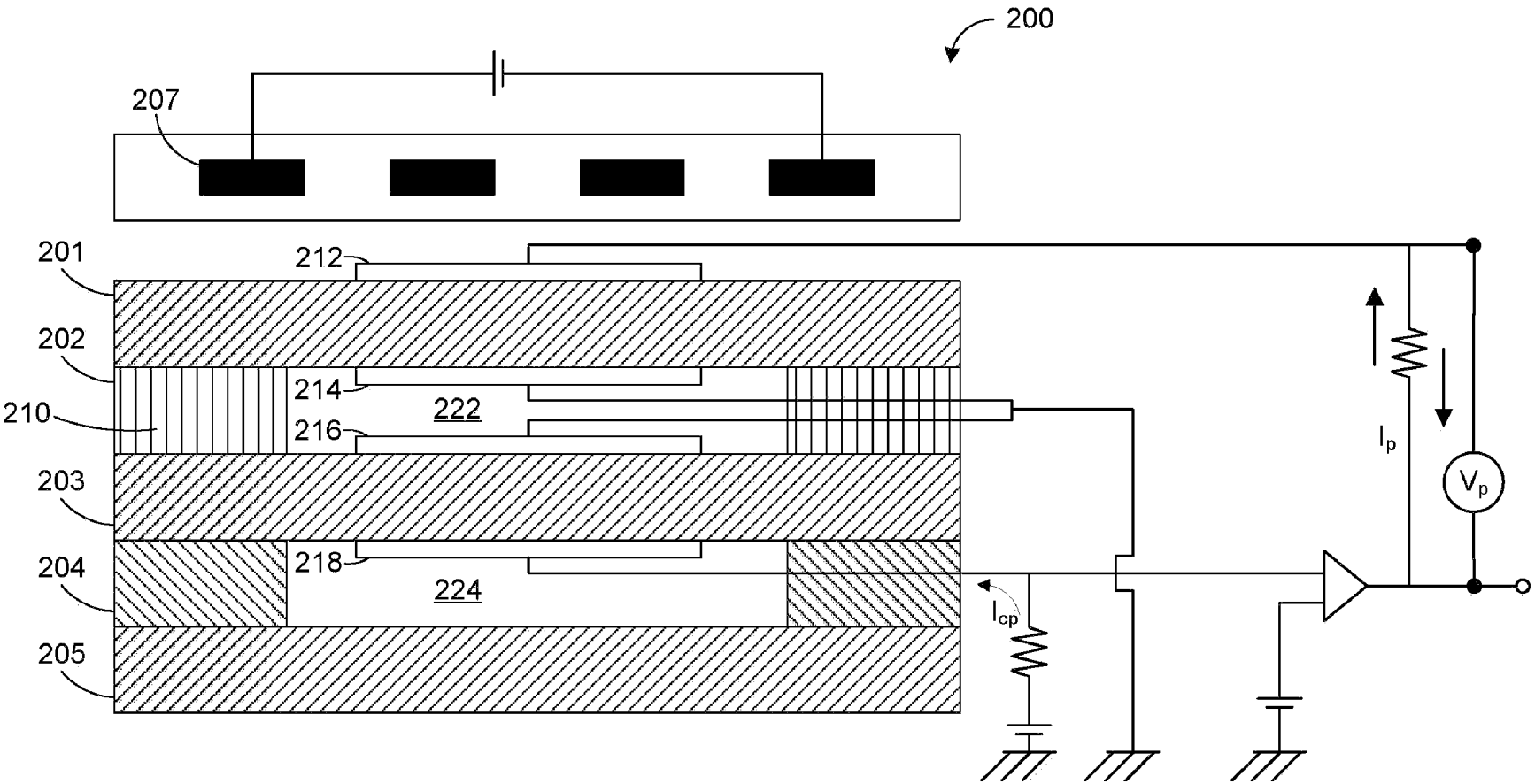
FIG. 2 shows a schematic diagram of an example universal exhaust gas oxygen sensor.

FIG. 2 shows a schematic view of an example embodiment of a UEGO sensor 200 configured to measure a concentration of oxygen ($O_2$) in an exhaust gas stream. Sensor 200 may operate as the UEGO sensor 126 of FIG. 1, for example. Sensor 200 comprises a plurality of layers of one or more ceramic materials arranged in a stacked configuration. In the embodiment of FIG. 2, five ceramic layers are depicted as layers 201, 202, 203, 204, and 205. These layers include one or more layers of a solid electrolyte capable of conducting ionic oxygen. Examples of suitable solid electrolytes include, but are not limited to, zirconium oxide-based materials. Further, in some embodiments, a heater 207 may be disposed in thermal communication with the layers to increase the ionic conductivity of the layers. While the depicted UEGO sensor is formed from five ceramic layers, it will be appreciated that the UEGO sensor may include other suitable numbers of ceramic layers.

Layer 202 includes a material or materials creating a diffusion path 210. Diffusion path 210 is configured to introduce exhaust gases into a first internal cavity 222 via diffusion. Diffusion path 210 may be configured to allow one or more components of exhaust gases, including but not limited to a desired analyte (e.g., $O_2$), to diffuse into internal cavity 222 at a more limiting rate than the analyte can be pumped in or out by pumping electrodes pair 212 and 214. In this manner, a stoichiometric level of $O_2$ may be obtained in the first internal cavity 222.

Sensor 200 further includes a second internal cavity 224 within layer 204 separated from the first internal cavity 222 by layer 203. The second internal cavity 224 is configured to maintain a constant oxygen partial pressure equivalent to a stoichiometric condition, e.g., an oxygen level present in the second internal cavity 224 is equal to that which the exhaust gas would have if the air-fuel ratio was stoichiometric. The oxygen concentration in the second internal cavity 224 is held constant by pumping current $I_{cp}$. Herein, second internal cavity 224 may be referred to as a reference cell.

A pair of sensing electrodes 216 and 218 is disposed in communication with first internal cavity 222 and reference cell 224. The sensing electrodes pair 216 and 218 detects a concentration gradient that may develop between the first internal cavity 222 and the reference cell 224 due to an oxygen concentration in the exhaust gas that is higher than or lower than the stoichiometric level. A high oxygen concentration may be caused by a lean exhaust gas mixture, while a low oxygen concentration may be caused by a rich mixture.

A pair of pumping electrodes 212 and 214 is disposed in communication with internal cavity 222, and is configured to electrochemically pump a selected gas constituent (e.g., $O_2$) from internal cavity 222 through layer 201 and out of sensor 200. Alternatively, the pair of pumping electrodes 212 and 214 may be configured to electrochemically pump a selected gas through layer 201 and into internal cavity 222. Herein, pumping electrodes pair 212 and 214 may be referred to as an $O_2$ pumping cell.

Electrodes 212, 214, 216, and 218 may be made of various suitable materials. In some embodiments, electrodes 212, 214, 216, and 218 may be at least partially made of a material that catalyzes the dissociation of molecular oxygen. Examples of such materials include, but are not limited to, electrodes containing platinum and/or gold.

The process of electrochemically pumping the oxygen out of or into internal cavity 222 includes applying an electric current $I_p$ across pumping electrodes pair 212 and 214. The pumping current $I_p$ applied to the $O_2$ pumping cell pumps oxygen into or out of first internal cavity 222 in order to maintain a stoichiometric level of oxygen in the cavity pumping cell. The pumping current $I_p$ is proportional to the concentration of oxygen in the exhaust gas. Thus, a lean mixture will cause oxygen to be pumped out of internal cavity 222 and a rich mixture will cause oxygen to be pumped into internal cavity 222.

A control system (not shown in FIG. 2) generates the pumping voltage signal VP as a function of the intensity of the pumping current $I_p$ required to maintain a stoichiometric level within the first internal cavity 222.

It should be appreciated that the UEGO sensor described herein is merely an example embodiment of a UEGO sensor, and that other embodiments of UEGO sensors may have additional and/or alternative features and/or designs.

Figure 3:
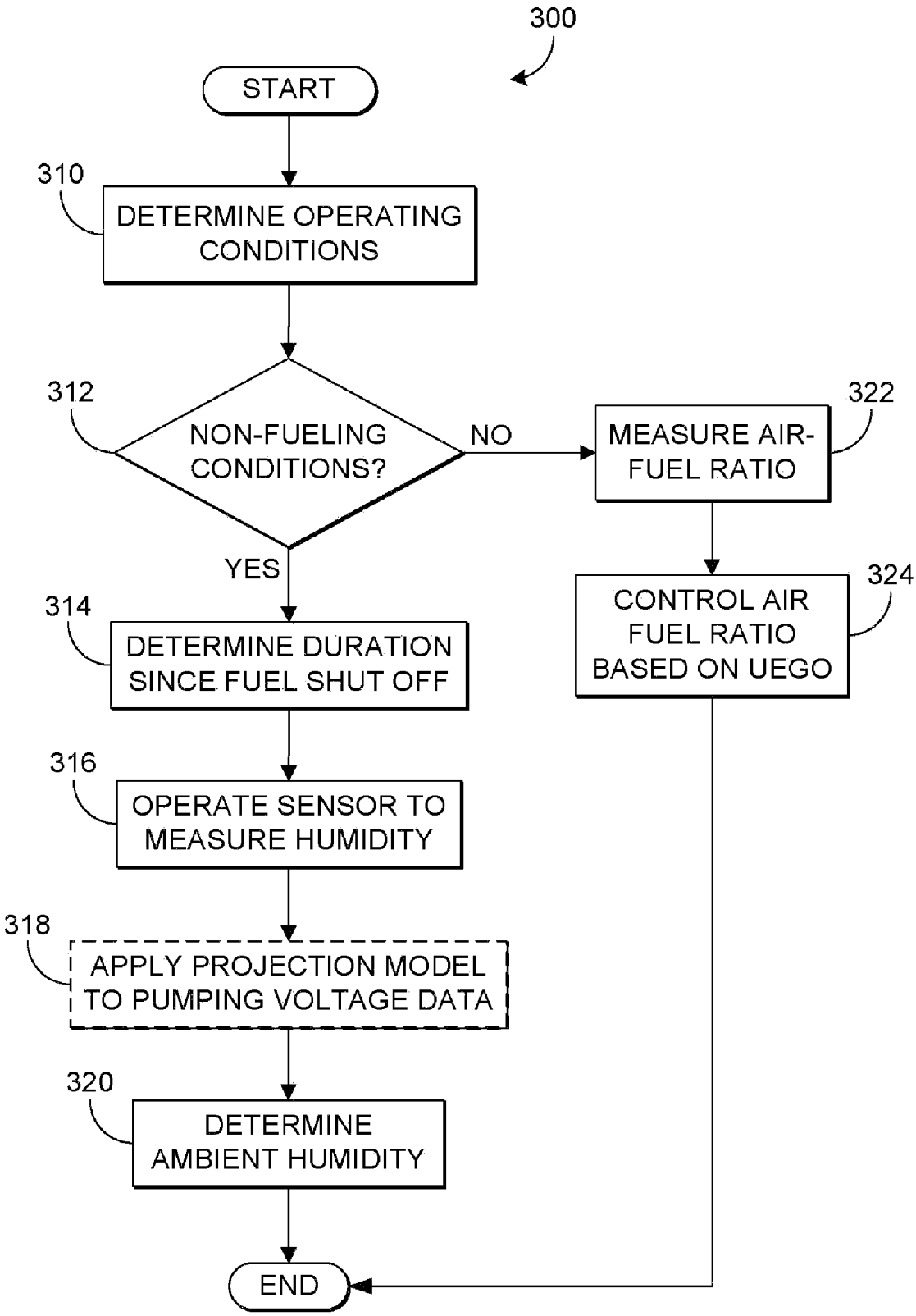
FIG. 3 is a flow chart illustrating a routine for operating a universal exhaust gas oxygen sensor.

FIG. 3 shows a flow chart illustrating a routine 300 for operating a universal exhaust gas oxygen sensor (UEGO), such as that illustrated in FIG. 2, and positioned as indicated in FIG. 1, for example. Specifically, the procedure determines the operating mode of the sensor and subsequently operates the sensor in the specified mode to obtain corresponding measurements. As such, depending on the fueling conditions of the engine, the UEGO sensor may operate in a first mode as a humidity sensor to determine the ambient humidity or the sensor may operate in a second mode as an oxygen sensor to detect the air fuel ratio and provide engine air-fuel ratio feedback. Engine operating parameters may be adjusted in response to the sensor measurements, as will be described later with reference to FIG. 4.

At 310 of routine 300 in FIG. 3, operating conditions of the engine are determined. These include, but are not limited to, actual/desired EGR flow, spark timing, VCT, and air-fuel ratio, etc.

Once the operating conditions are determined, it is determined if the engine is under non-fueling conditions at 312 of routine 300. Non-fueling conditions include engine operating conditions in which the fuel supply is interrupted but the engine continues spinning and at least one intake valve and one exhaust valve are operating; thus, air is flowing through one or more of the cylinders, but fuel is not injected in the cylinders. Under non-fueling conditions, combustion is not carried and ambient air may move through the cylinder from the intake to the exhaust. In this way, a sensor, such as a UEGO sensor, may receive ambient air on which measurements, such as ambient humidity detection, may be performed.

Non-fueling conditions may include, for example, deceleration fuel shut off (DFSO). DFSO is responsive to the operator pedal (e.g., in response to a driver tip-out and where the vehicle accelerates greater than a threshold amount). DSFO conditions may occur repeatedly during a drive cycle, and, thus, numerous indications of the ambient humidity may be generated throughout the drive cycle, such as during each DFSO event. As such, the overall efficiency of the engine may be maintained during driving cycles in which the ambient humidity fluctuates. The ambient humidity may fluctuate due to a change in altitude or temperature or when the vehicle enters/exits fog or rain, for example. The length of time DFSO conditions last, however, may vary, as will be described below.

In some embodiments, non-fueling conditions may include controlled injector shut off during engine flare down after engine start. In this example, early detection of absolute ambient humidity may be achieved.

If it is determined that the engine is operating under non-fueling conditions at 312, routine 300 proceeds to 314 where a duration since fuel shut off is determined. Residual gases from one or more previous combustion cycles may remain in the exhaust for several cycles after fuel is shut off and the gas that is exhausted from the chamber may contain more than ambient air. Measurement of the absolute ambient humidity may be delayed for a duration after fuel shut off, therefore, in order to allow previously combusted gases to exit the exhaust in the area where the sensor is positioned. In some embodiments, the duration may be a period of time since fuel shut off. In other embodiments, the duration may be a number of engine cycles since fuel shut off.

Figure 5:
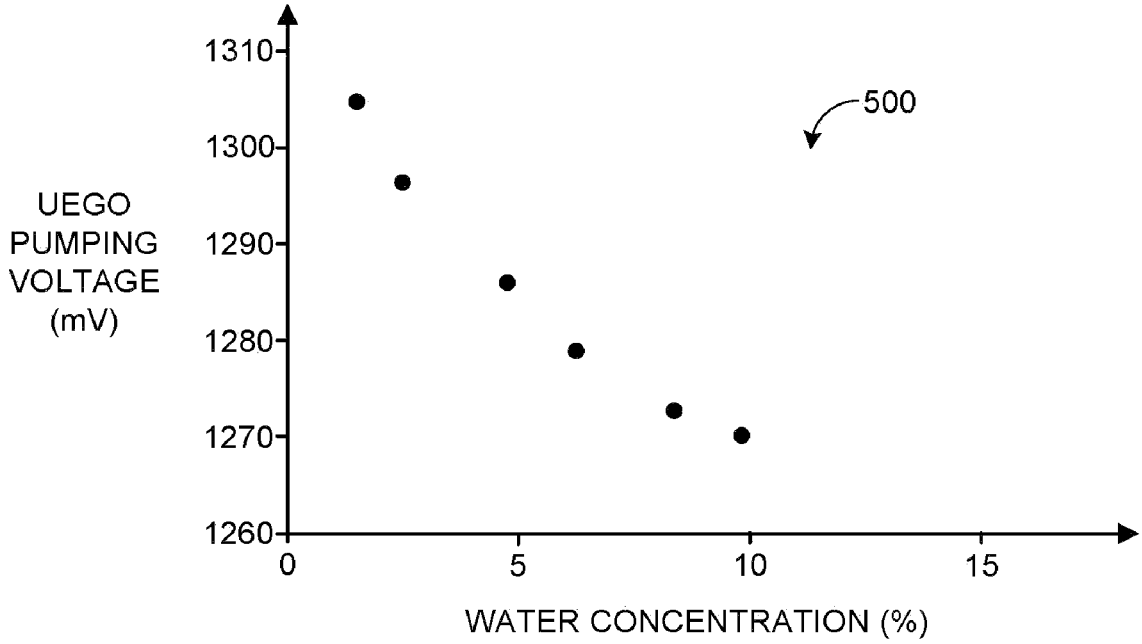
FIG. 5 shows an example map illustrating a projected equilibrium pumping voltage of an exhaust gas sensor.

At 316 of routine 300, the sensor is operated as a humidity sensor. In one example, absolute ambient humidity may be detected by monitoring the pumping voltage $V_p$ associated with the pumping cell of a UEGO sensor, such as the sensor of FIG. 2. FIG. 5 shows an example graph 500 demonstrating pumping voltage dependence on water concentration. The data in graph 500 was obtained in an atmosphere comprising 20% oxygen, which is approximately the amount of oxygen in ambient air. As shown in graph 500, the pumping voltage of a UEGO sensor decreases with an increase in humidity.

Similar data to that shown in FIG. 5 may be stored on a computer readable storage medium of a control system receiving communication from the UEGO sensor. The medium may include instructions thereon for identifying an ambient humidity based on the stored pumping voltage vs. water concentration data. In this manner, the ambient humidity is determined at 320 of routine 300 in FIG. 3.

As stated above, the ambient humidity as determined is the absolute ambient humidity. Additionally, relative humidity may be obtained by further employing a temperature detecting device, such as a temperature sensor.

As noted above, the period in which fuel is shut off may vary. For example, a vehicle operator may release the accelerator pedal and coast to a stop, resulting in a long DFSO period. In some situations, the fuel shut off period (the time from interruption of the fuel supply to restart of the fuel supply, for example) may not be long enough for the ambient air to establish an equilibrium state in the exhaust system; thus, the ambient humidity reading may be inaccurate. For example, a vehicle operator may tip-in shortly after releasing the accelerator pedal, causing DFSO to stop soon after beginning. In such a situation, routine 300 proceeds to 318.

At 318 of routine 300, a projection model is applied to the pumping voltage data. In some embodiments of the present invention, the pumping voltage data that is obtained from the UEGO sensor may be fitted to a curve, which may be an exponential curve, for example. The control system may include instructions for interpreting the curve in order to identify variables, including the steady state value of the pumping voltage. In this way, the steady state value of the pumping voltage may be estimated, or projected, based on a trajectory of the readings during the fuel shut off event, even if the fuel shut off period is not long enough for the ambient air to reach equilibrium.

Figure 6:
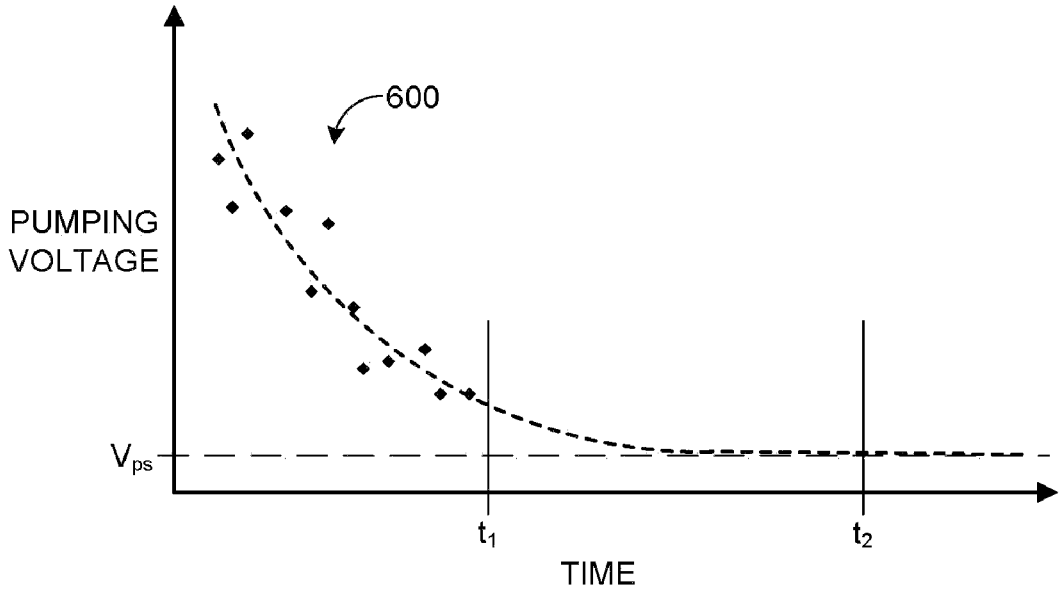
FIG. 6 shows an example map demonstrating a relationship between sensor pumping voltage and water concentration.

FIG. 6 shows an example graph 600 of an exponential projection model applied to UEGO sensor pumping voltage data. In the example of FIG. 6, non-fueling conditions, such as DFSO, may end at time $t_1$, a time at which the pumping voltage has not yet reached a steady state; thus, an accurate ambient humidity may not be determined at time $t_1$. With the application of the projection model (denoted by the dashed curve in FIG. 6) based on a plurality of sensor readings during the DFSO event, however, the pumping voltage may be estimated as though it is a later time $t_2$, at which the pumping voltage has reached a steady state $V_{ps}$. As described above, the absolute ambient humidity may be identified based on the steady state pumping voltage by the control system at 320 of FIG. 3.

Referring back to 312 in FIG. 3, if it is determined that the engine is not operating under non-fueling conditions, for example, fuel is injected in one or more cylinders of the engine, routine 300 advances to 322. At 322, the exhaust gas sensor is operated as an air-fuel ratio sensor. In this second mode of operation, the sensor may be operated as a lambda sensor. As a lambda sensor, the output voltage may determine whether the exhaust gas air-fuel ratio is lean or rich. Alternatively, the sensor may operate as a universal exhaust gas oxygen sensor (UEGO) and an air-fuel ratio (e.g., a degree of deviation from a stoichiometric ratio) may be obtained from the pumping current of the pumping cell.

At 324 of routine 300, the air-fuel ratio (AFR) is controlled responsive to the exhaust gas oxygen sensor. Thus, a desired exhaust gas AFR may be maintained based on feedback from the sensor during engine fueling conditions. For example, if a desired air-fuel ratio is the stoichiometric ratio and the sensor determines the exhaust gas is lean (i.e., the exhaust gas comprises excess oxygen and the AFR is less than stoichiometric), additional fuel may be injected during subsequent engine fueling operation.

As described in detail above, an exhaust gas sensor may be operated in at least two modes in which the pumping voltage or pumping current of the pumping cell is monitored. As such, the sensor may be employed to determine the absolute ambient humidity of the air surrounding the vehicle as well as the air-fuel ratio of the exhaust gas. Subsequent to detection of the ambient humidity, a plurality of engine operating parameters may be adjusted for optimal engine performance, which will be explained in detail below. These parameters include, but are not limited to, an amount of exhaust gas recirculation (EGR), variable cam timing (VCT), spark timing, and air-fuel ratio.

Figure 4:
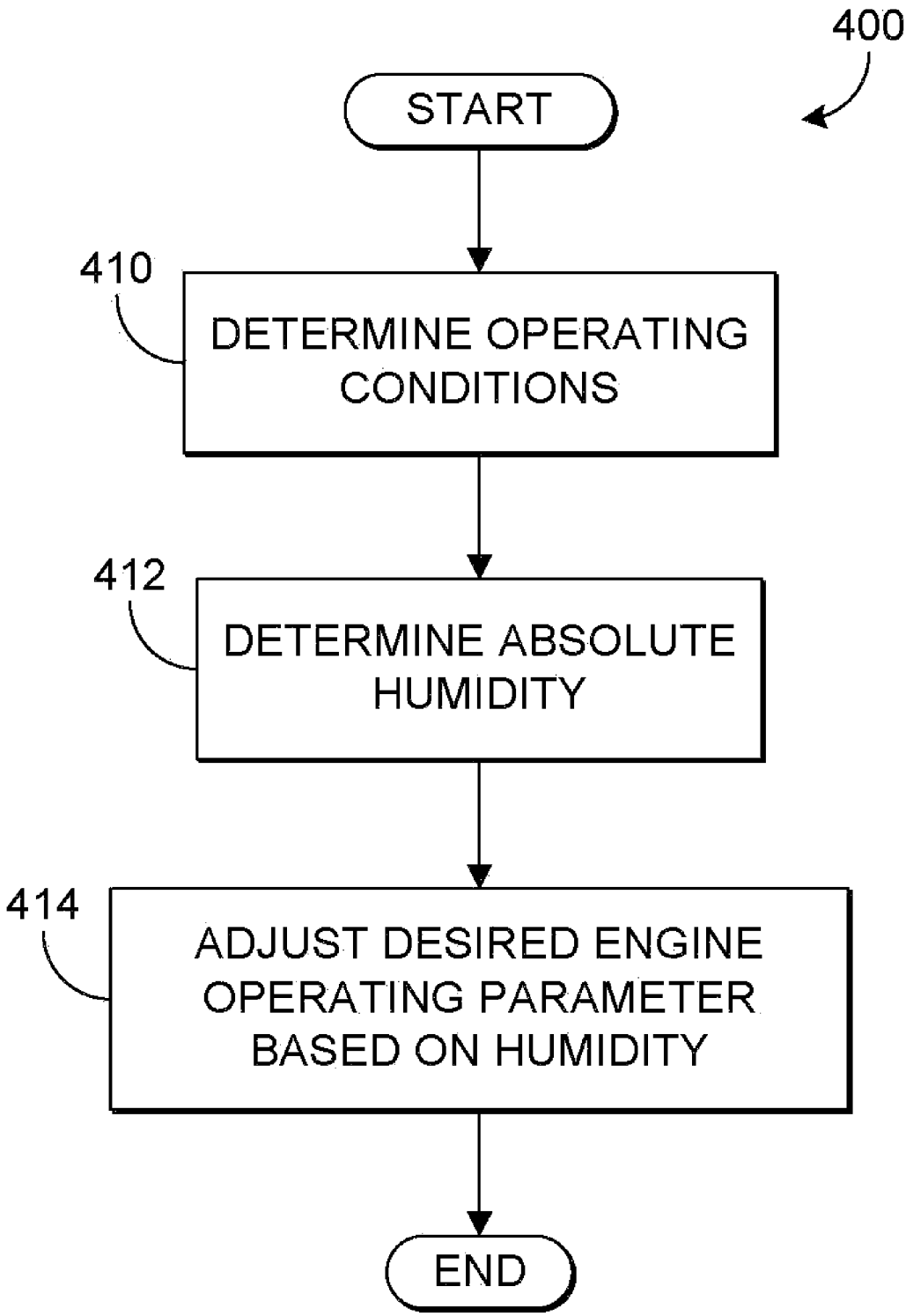
FIG. 4 is a flow chart illustrating a control routine for adjusting engine operating parameters.

Referring now to FIG. 4, a flow chart depicting a general control routine 400 for adjusting engine operating parameters responsive to an absolute ambient humidity measurement is shown. Specifically, one or more engine operating parameters may be adjusted corresponding to a change in ambient humidity. For example, an increase in water concentration of the air surrounding the vehicle may dilute a charge mixture delivered to a combustion chamber of the engine. If one or more operating parameters are not adjusted in response to the increase in humidity, engine performance and fuel economy may decrease and emissions may increase; thus, the overall efficiency of the engine may be reduced.

At 410 of routine 400, engine operating conditions are determined. In particular, the operating conditions may include EGR, spark timing, air-fuel ratio, and VCT, among others, which may be affected by fluctuations of the water concentration in ambient air. Once the operating conditions are established, the routine continues to 412 where the absolute ambient humidity is determined. The ambient humidity may be determined with an exhaust gas sensor via the methods described above. Alternatively, the ambient humidity may be detected by a humidity sensor disposed in one or more of various locations including within the exhaust passage.

Responsive to the ambient humidity determined at 412, a plurality of operating parameters may be adjusted under selected engine combusting conditions at 414 of routine 400. Such operating parameters may include an amount of EGR, spark timing, air-fuel ratio, and VCT, among others. As described above, in internal combustion engines, it is desirable to schedule engine operating parameters, such as spark timing and camshaft timing, in order to optimize engine performance. In some embodiments, only one parameter may be adjusted in response to the humidity. In other embodiments, any combination or subcombination of these operating parameters may be adjusted in response to measured fluctuations in ambient humidity.

In one example embodiment, an amount of exhaust gas recirculation (EGR) may be adjusted based on the measured ambient humidity. For example, in one condition, the water concentration in the air surrounding the vehicle may have increased due to a weather condition such as fog; thus, a higher humidity is detected by the exhaust gas sensor during engine non-fueling conditions. In response to the increased humidity measurement, during subsequent engine fueling operation, the EGR flow into at least one combustion chamber may be reduced. As a result, engine efficiency may be maintained.

Responsive to a fluctuation in absolute ambient humidity, EGR flow may be increased or decreased in at least one combustion chamber. As such, the EGR flow may be increased or decreased in only one combustion chamber, in some combustion chambers, or in all combustion chambers. Furthermore, the magnitude of change of the EGR flow may be the same for all cylinders or the magnitude of change of the EGR flow may vary by cylinder based on the specific operating conditions of each cylinder.

In another embodiment, spark timing may be adjusted responsive to the ambient humidity. In at least one condition, for example, spark timing may be advanced in one or more cylinders during subsequent engine fueling operation responsive to a higher humidity reading. Spark timing may be scheduled so as to reduce knock in low humidity conditions (e.g., retarded from a peak torque timing), for example. When an increase in humidity is detected by the UEGO sensor, spark timing may be advanced in order to maintain engine performance and operate closer to or at a peak torque spark timing.

Additionally, spark timing may be retarded in response to a decrease in ambient humidity. For example, a decrease in ambient humidity from a higher humidity may cause knock. If the decrease in humidity is detected by the UEGO sensor during non-fueling conditions, such as DFSO, spark timing may be retarded during subsequent engine fueling operation and knock may be reduced.

It should be noted that spark may be advanced or retarded in one or more cylinders during subsequent engine fueling operation. Further, the magnitude of change of spark timing may be the same for all cylinders or one or more cylinders may have varying magnitudes of spark advance or retard.

In a further example embodiment, variable cam timing (VCT), and thus valve timing, may be adjusted during subsequent engine fueling operation based on the ambient humidity. Camshaft timing may be set for optimal fuel economy and emissions corresponding to a low ambient humidity, for example. In order to maintain optimal fuel economy and emissions and prevent engine misfire, camshaft timing may be adjusted for one or more cylinder valves during subsequent engine fueling operation in response to a measured increase or in ambient humidity. Depending on the current VCT schedule and the time of cam timing adjustment, various combinations of valves may be adjusted; for example, one or more exhaust valves, one or more intakes valves, or a combination of one more intake valves and one or more exhaust valves may be adjusted. Furthermore, VCT may be adjusted in a similar manner responsive to a measured decrease in ambient humidity.

In still another example embodiment, exhaust gas air-fuel ratio may be adjusted responsive to the measured ambient humidity during subsequent engine fueling operation. For example, an engine may be operating with a lean air-fuel ratio optimized for low humidity. In the event of an increase in humidity, the mixture may become diluted, resulting in engine misfire. If the increase in humidity is detected by the UEGO sensor during non-fueling conditions, however, the AFR may be adjusted so that the engine will operate with a less lean, lean air-fuel ratio during subsequent fueling operation. Likewise, an AFR may be adjusted to be a more lean, lean air-fuel ratio during subsequent engine fueling operation in response to a measured decrease in ambient humidity. In this way, conditions such as engine misfire due to humidity fluctuations may be reduced.

In some examples, an engine may be operating with a stoichiometric air-fuel ratio or a rich air-fuel ratio. As such, the AFR may be independent of ambient humidity and measured fluctuations in humidity may not result in an adjustment of AFR.

In this way, engine operating parameters may be adjusted responsive to an ambient humidity generated by an exhaust gas sensor coupled to an engine exhaust system. As DFSO may occur numerous times during a drive cycle, an ambient humidity measurement may be generated several times throughout the drive cycle and one or more engine operating parameters may be adjusted accordingly, resulting in an optimized overall engine performance despite fluctuations in ambient humidity.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method of controlling an engine of a vehicle having an exhaust and an exhaust gas sensor coupled therein, comprising:

during engine spinning and non-fueling conditions, where at least one intake valve and at least one exhaust valve of the engine are operating: generating an ambient humidity from the exhaust gas sensor; and under selected engine combusting conditions, adjusting an engine operating parameter based on the ambient humidity.

2. The method of claim 1 wherein the ambient humidity is an absolute ambient humidity.

3. The method of claim 2 wherein the ambient humidity is generated after a duration since fuel shut off.

4. The method of claim 2 wherein the ambient humidity is further based on a projected equilibrium of the exhaust gas sensor.

5. The method of claim 2 wherein the engine operating parameter includes an amount of exhaust gas recirculation during subsequent engine fueling operation.

6. The method of claim 5 wherein the adjusting of the amount of exhaust gas recirculation includes in at least one condition, reducing the amount of exhaust gas recirculation in response to a higher humidity.

7. The method of claim 2 wherein the engine operating parameter includes spark timing during subsequent engine fueling operation.

8. The method of claim 7 wherein the adjusting of spark timing includes during at least one condition, advancing the spark timing in response to a higher humidity.

9. The method of claim 2 wherein the engine operating parameter includes engine air-fuel ratio during subsequent engine fueling operation.

10. The method of claim 9 wherein adjusting the air-fuel ratio includes in at least one condition, increasing a lean air-fuel ratio in response to a higher ambient humidity.

11. The method of claim 2 wherein the engine operating parameter includes variable cam timing during subsequent engine fueling operation.

12. The method of claim 2 wherein adjusting the engine operating parameter based on the ambient humidity includes adjusting each of exhaust gas recirculation, spark timing, air-fuel ratio, and variable cam timing during subsequent engine fueling operation based on the humidity.

13. The method of claim 1 further comprising adjusting an engine combustion air-fuel ratio to maintain a desired exhaust air-fuel ratio based on feedback from the sensor during engine fueling conditions.

14. The method of claim 1 wherein engine non-fueling conditions include deceleration fuel shut off.

15. The method of claim 1 wherein the exhaust gas sensor is a universal exhaust gas oxygen sensor.

16. A method of controlling an engine of a vehicle during engine operation, the engine having an exhaust, an exhaust gas sensor coupled in the engine exhaust, and an exhaust gas recirculation system, the method comprising:

during a first mode including engine spinning and non-fueling conditions, where at least one intake valve and at least one exhaust valve of the engine are operating:

generating an ambient humidity from the exhaust gas sensor;

during a second mode including engine combusting conditions subsequent to the first mode, generating an exhaust air-fuel ratio from the exhaust gas sensor; adjusting a desired engine air-fuel ratio based on the ambient humidity, adjusting an amount of exhaust gas recirculation based on the ambient humidity, and adjusting fuel injection into the engine to maintain the desired air-fuel ratio in response to feedback from the exhaust gas sensor including an exhaust air-fuel ratio reading of the exhaust gas sensor.

17. The method of claim 16 wherein the engine non-fueling conditions include deceleration fuel shut off, and wherein the generated ambient humidity is an absolute humidity reading.

18. A system for an engine in a vehicle, the system comprising:

an engine exhaust system;

a universal exhaust gas oxygen sensor coupled in the exhaust having an oxygen pumping cell and an associated pumping voltage; and a control system including a computer readable storage medium, the medium including instructions thereon, the control system receiving communication from the exhaust gas sensor, the medium comprising:

instructions for, during an engine spinning and non fueling condition and after a time since fuel shut off, identifying an ambient humidity based on the pumping voltage of the exhaust gas sensor communication; and instructions for, during a subsequent engine fueling condition, identifying an air-fuel ratio based on the exhaust gas sensor and instructions for adjusting an engine operating condition in response to the identified ambient humidity.

19. The system of claim 18 wherein the ambient humidity is an absolute humidity.

20. The system of claim 18 wherein an estimated increase in humidity is based on a decrease in pumping voltage of the exhaust gas sensor.

* * * * *